US006705282B2

(12) United States Patent
Hlavac

(10) Patent No.: US 6,705,282 B2
(45) Date of Patent: Mar. 16, 2004

(54) METHOD AND APPARATUS TO PROVIDE ENGINE COMPRESSION BRAKING

(75) Inventor: David S. Hlavac, New Lenox, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 146 days.

(21) Appl. No.: 10/087,029

(22) Filed: Mar. 1, 2002

(65) Prior Publication Data

US 2003/0164153 A1 Sep. 4, 2003

(51) Int. Cl.[7] ..... F02D 13/04
(52) U.S. Cl. ..... 123/322; 123/446
(58) Field of Search ..... 123/322, 321, 123/446

(56) References Cited

U.S. PATENT DOCUMENTS 5,012,778 A 5/1991 Pitzi
5,564,386 A * 10/1996 Korte et al. ..... 123/321
5,609,134 A * 3/1997 Schmidt et al. ..... 123/322
5,758,620 A 6/1998 Warner
RE36,007 E 12/1998 White et al.
5,921,883 A 7/1999 Bellinger
6,349,253 B1 2/2002 Bellinger

* cited by examiner

*Primary Examiner*—Henry C. Yuen
*Assistant Examiner*—Arnold Castro
(74) *Attorney, Agent, or Firm*—Susan L. Lukasik; Dennis Kelly Sullivan; Jeffrey P. Calfa

(57) ABSTRACT

In internal combustion engines that use hydraulic-fluid actuated fuel injectors, enhanced engine compression braking can be realized with simplified hydraulic control systems, by using fuel injector hydraulic fluid to open exhaust valves at or near the top of a compression stroke. Opening the exhaust valves at the top of a compression stroke wastes compressed gas to the atmosphere providing enhanced efficiency of engine compression braking. Using existing fuel injector high pressure fluid or engine oil to actuate a slave piston and thereby actuate the exhaust valve obviates the need for a separate, dedicated high-pressure oil delivery system for engine compression braking purposes.

17 Claims, 2 Drawing Sheets

METHOD AND APPARATUS TO PROVIDE ENGINE COMPRESSION BRAKING

FIELD OF THE INVENTION

The present invention relates generally to a compression brake system that provides retarding horsepower in an internal combustion engine, and particularly to a compression brake system using compressed engine oil to actuate actuator pistons that open exhaust valves at predetermined times.

BACKGROUND OF THE INVENTION

Compression or decompression brake systems are commonly known and used in internal combustion engines for trucks and other vehicles. Generally, a compression brake augments the conventional vehicle brake system thereby protecting the conventional brake system from excessive wear. Two well known compression brakes are a lost motion design and an electro-mechanical design. The lost-motion brake utilizes and additional lobe on the engine's cam to open the exhaust valve when needed. The electro-mechanical brake generally uses high pressure or compressed engine oil or fluid to activate slave pistons that open the exhaust valves.

As is know by those of skill in the art, the basic function of the decompression brake is to open an exhaust valve of a given cylinder at the end of the compression cycle when there is compressed air in the cylinder. The opening of the exhaust valve allows the power cylinder to "decompress" and thus removes energy. By allowing the compressed gas within the cylinder to be purged prematurely through the open exhaust valve, the mechanical energy that was required to compress the gas can be wasted through the open exhaust valve, instead of being transferred back into the engine during the ensuing "power stroke." As a result, the engine absorbs and dissipates more energy than it otherwise normally would and thus provides retarding horsepower to the vehicle. This allows the vehicle to be slowed down. Typically, this process only occurs when the brake function is armed and then activated by the driver removing their foot from the accelerator pedal. When the input signal conditions are right, the fuel injectors stop supplying fuel to the power cylinders and the brake cycle begins.

In prior art engine compression brakes, opening the exhaust valve at, or near, the conclusion of the compression stroke required the application of axial force to the exhaust valve thereby causing the valve to open. In at least one type of prior art engine, mechanical force required to overcome the exhaust valve spring and to open the valve was provided by an actuator piston located "above" or extant the exhaust valve stem and to which compressed engine oil was delivered, hydraulically opening the valve by pulsing the actuator piston at predetermined times.

These prior art hydraulic engine compression braking systems often require their own high-pressure oil systems, fast-acting actuators and precise timing in order to open the exhaust valve when the piston is at or near the top of the compression stroke. Some of these prior art engines also use pressurized engine oil to control the opening of the diesel fuel injectors, requiring two separate complex, high-pressure engine oil systems that both deliver pulses of high-pressure engine oil. Eliminating at least one of the complex, high-pressure oil control systems in such prior art engines would yield a higher-reliable engine compression braking system at a reduced cost.

SUMMARY OF THE INVENTION

The present invention provides a method and apparatus for engine compression braking for an internal combustion engine that uses hydraulic-fluid-actuated fuel injectors, where the engine compression braking can be provided by diverting or re-routing hydraulic fluid that would normally open the fuel injectors, to slave engine compression brake actuator pistons which are mechanically coupled to the exhaust valves so as to cause the exhaust valves to open at the time that the fuel injectors would have been opened to inject fuel.

There is provided a method for compression engine braking in an internal combustion engine, having a source of pressurized fluid for a hydraulically-actuated fuel injector, comprising the steps of activating compression engine braking mode, generating a diverter valve actuation signal in an engine computer, actuating the diverter valve based on the diverter valve actuation signal thereby diverting the pressurized fluid to the fuel injector towards a slave piston, actuating the slave piston via the diverted high pressure fluid, and actuating an exhaust valve, via the slave piston, for a predetermined amount of time at or near the top of a compression stroke via translation of the slave piston movement to thereby vent compressed gases in a combustion chamber to the atmosphere.

In an alternate embodiment, the method for compression engine braking in an internal combustion engine further comprises actuating a diverter valve based on a diverter valve actuation signal thereby diverting the pressurized fluid from the fuel injector towards a stroke limiter piston. The stroke limiter piston is then actuated via the diverted high pressure fluid. Next, the slave piston is actuated by translating the movement of the stroke limiter piston via hydraulic coupling means between the stroke limiter and the slave piston. As before, the exhaust valve is actuated for a predetermined amount of time at or near the top of a compression stroke, by translation of the slave piston movement, to thereby vent compressed gases in a combustion chamber to the atmosphere.

In another embodiment, there is provided a compression engine brake for an internal combustion engine having a source of pressurized fluid for at least one hydraulically-actuated fuel injector, at least one fuel injector control valve for selectively delivering pressurized fluid to a corresponding fuel injector, at least one exhaust valve through which combustion chamber gases can travel from the combustion chamber to the atmosphere, and an engine computer for monitoring and controlling engine functions. The engine compression brake comprises a diverter control valve for diverting pressurized fluid from the fuel injector in response to a diverter control valve actuation signal from the engine computer, and a slave piston for opening the exhaust valve in response to the diverted pressurized fluid to thereby vent compressed gases in a combustion chamber to the atmosphere.

In another alternate embodiment, there is provided a compression engine brake for an internal combustion engine having a source of pressurized fluid for at least one hydraulically-actuated fuel injector, at least one fuel injector control valve for selectively delivering pressurized fluid to a corresponding fuel injector, at least one exhaust valve through which combustion chamber gases can travel from a combustion chamber to the atmosphere, and an engine computer for monitoring and controlling engine functions. The engine compression brake comprises a diverter control valve for diverting pressurized fluid from the fuel injector in response to a diverter control valve actuation signal from the engine computer, a stroke limiter piston having an input face for receiving the diverted pressurized fluid and an output face such that upon the diversion of the pressurized fluid to the stroke limiter piston input face, the stroke limiter piston is displaced, and a slave piston hydraulically coupled to the stroke limiter piston via the output face such that the stroke limiter piston displacement displaces the slave piston which in turn actuates and opens a corresponding exhaust valve at substantially the end of the engine's compression stroke to vent compressed gases from the combustion chamber to the atmosphere.

The following drawings and description set forth additional advantages and benefits of the invention. More advantages and benefits will be obvious from the description and may be learned by practice of the invention.

BRIEF DESCRIPTION OF THE DRAWINGS

The present invention may be better understood when read in connection with the accompanying drawings, of which.

DETAILED DESCRIPTION OF THE PREFERRED EMBODIMENT

Figure 1:
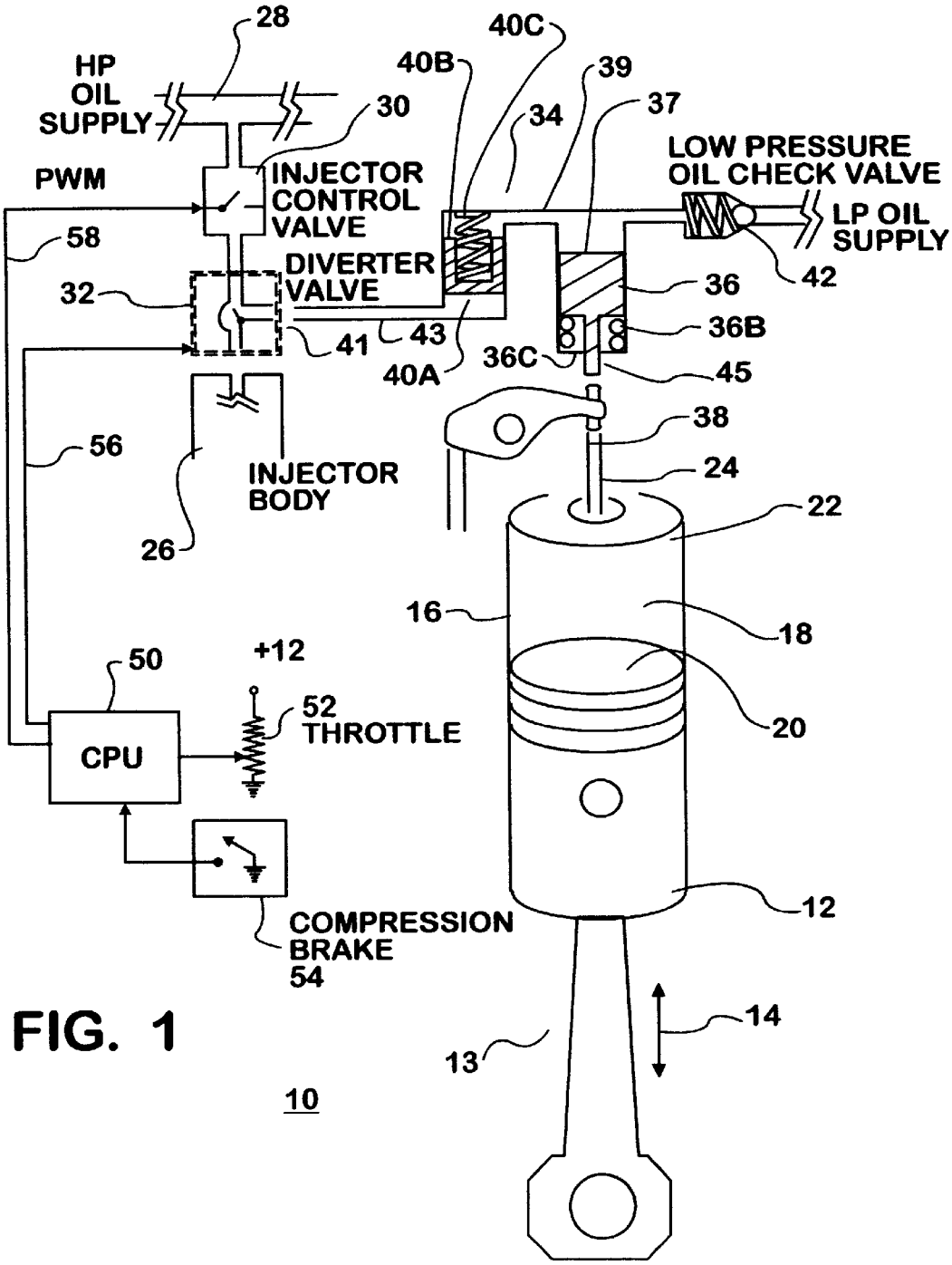
FIG. 1 depicts a simplified schematic diagram of the components of an embodiment of the system and method to provide engine compression braking according to the present invention.

FIG. 1 shows a simplified schematic representation of an apparatus to provide engine compression braking 10 according to a preferred embodiment of the present invention. Although the preferred embodiment contemplates use with a diesel-cycle internal combustion engine, those of ordinary skill in the art will readily recognize that the embodiment disclosed herein could also be used with a gasoline-fueled internal combustion engine application.

As is known in the art, pistons 12 (only one shown for simplicity) reciprocate in corresponding cylinders 16 (a partial one shown in cross-section) in response to rotation of a crankshaft (not shown for simplicity) to which the piston connecting rod 13 is rotatably affixed via the connecting rod journal. The piston 12 is shown in FIG. 1 as traveling in the direction indicated by the arrows 14, however, the invention disclosed and claimed herein does not require the piston to travel in any particular direction or spatial orientation.

In a four-cycle internal combustion engine, the piston 12 completes four separate strokes or cycles, as is well know, during which an intake valve (not shown) opens thereby allowing outside air into the combustion chamber 18 as the piston 12 travels downward 14 away from the intake and exhaust 24 valves, which are usually located at or near the top of the cylinder 22, e.g. in a cylinder head (not shown). In a gasoline-fueled engine, air and fuel are drawn into the combustion chamber together during the intake stroke. In a diesel-cycle engine, only air enters the combustion chamber when the intake valve opens. A compression stroke follows the intake stroke.

When the piston 20 approaches or reaches the bottom of its intake-stroke travel, the intake valve closes. As the crankshaft to which the piston's 12 connecting rod 13 is attached, continues it's rotation, the piston eventually stops and reverses its travel to begin moving upward beginning the combustion stroke. In the embodiment shown in FIG. 1 the piston 12 is shown as moving vertically, however alternate embodiments would include pistons moving in any spatial orientation. As the piston moves toward the top of the cylinder 22, gas (i.e., air) within the cylinder 22 is compressed. Alternatively, in gasoline-fueled engines, air and fuel in the cylinder 22 is compressed.

During the compression stroke, both the intake valve and the exhaust valve 24 are held tightly closed as the piston 12 travels or rises in the cylinder 16. The compression of the air within the combustion chamber 18 by the piston's upward travel requires a delivery of a mechanical force to the piston 12 through the crankshaft (not shown) in order to overcome the counter or opposing force exerted on the piston by the gas as it is squeezed into an increasingly-smaller volume by the upwardly traveling piston 12. In an engine compression brake system, the "upward" piston 12 force (in the embodiment shown in FIG. 1) in the cylinder 22 is supplied or translated to the piston 12 from the momentum of a moving vehicle through the crankshaft to which the vehicle's wheels are coupled via a transmission and drive train.

In the preferred embodiment shown in FIG. 1, fuel is injected into the cylinder 22 for a diesel engine using a hydraulic-fluid-actuated fuel injector 26. Unlike electrically-actuated fuel injectors that are commonly used on many engines and which are made to open by an electrical current passing through a coil of wire to create a magnetic force, the hydraulic-fluid-actuated fuel injector 26 operates under the control of a high-pressure engine fluid or oil supply 28. The delivery of the high pressure engine fluid 28 to the fuel injector 26 is gated or controlled so as to open the injector using oil pressure. The hydraulic-fluid-actuated fuel injector 26 opens whenever the high-pressure engine oil supply 28 is "turned on" by an electronically-controlled injector control valve 30. When the injector control valve 30 is activated at a predetermined time by an appropriate injector control valve enabling signal 58 from the engine computer 50, the hydraulic fluid (engine oil) is introduced into the fuel injector body which thereby injects fuel into the combustion chamber 18. The operation and control of a fuel injector control valve 30 is not shown in FIG. 1 for simplicity. The operation and control of a fuel injector control valve 30 is known in the art, but only to control a fuel injector—not to control engine compression braking.

The injector control valve 30 depicted in FIG. 1 is shown schematically as a single pole, single pole switch so as to model the behavior of the injector control valve only. In a first position, high-pressure engine fluid or oil 28 is disconnected or isolated from the fuel injector body 26. In a second position, high-pressure engine fluid 28 is connected to the fuel injector 26 thereby causing the injector to open and allow fuel into the cylinder 18. In order to effectively meter fuel into the cylinder 18, the injector control valve 30 rapidly and controllably opens and closes the high pressure oil supply 28 to the injector body 26 through a diverter valve 32 so as to periodically activate the injector body 26 using hydraulic engine fluid 28.

Controlling the amount of fuel delivered to the engine is accomplished by holding the fuel injector 26 open for different lengths of time. The "open" time of the hydraulically-actuated injector 26 is controlled by controlling the length of time that the injector control valve 30 is held "open." The injector control valve 30 is operably coupled to a engine computer 50, which monitors an engine throttle position sensor 52 (among other engine parameters)

to sense whether to increase, decrease or maintain the engine's output power, (i.e. throttle position), and in response thereto, open, close or maintain the "open" time of the injector control valve 30. Fuel metering can be accomplished by pulse-width modulating the enabling signal 58 delivered to the injector control valve 30 from the computer 50.

In the preferred system of FIG. 1, the simplified engine compression braking system and method is achieved by using the high-pressure oil supply 28 that is provided for and used by the fuel injector 26, to open the cylinder 18 exhaust valve 24 instead. Re-direction of the high-pressure engine oil supply 28 is accomplished by way of a high-pressure oil diverter valve 32, which directs high-pressure engine oil to either the fuel injector 26, or, to a slave piston 36, mechanically coupled to the exhaust valve 24. The high-pressure oil diverter valve 32 re-directs the high engine oil 28 from the fuel injector 26 to the slave piston 36 under the direction of appropriate compression system signals 56 from the computer 50 upon the computer's 50 detection that engine compression braking is selected by the engine compression brake control input 54. Upon detection of the engine compression brake signal 54, the computer 50 activates (or deactivates) the diverter valve 32 so as to re-route the high-pressure engine oil 28 to the slave piston 36. Thereafter, the duration of the exhaust valve 24 open time can be adjusted by controlling the control signals 58 to the injector control valve 30.

During normal engine operation, the diverter valve 32 allows the high pressure oil supply 28 to be delivered to the injector body 26. The timing and control of the injector control valve 30, thereafter (by the computer 50) controls opening and closing of the fuel injector body 26. Not shown in FIG. 1 are timing circuits which sense various engine conditions or parameters, such as engine temperature, ambient temperature, engine load etc., so as to determine the optimal times at which the injector control valve 30 will open thereby determining the specific time and duration at which fuel is injected into the combustion chamber 18 for optimum control of combustion and emissions. Such devices are well known and used in prior art diesel engines, International Models DT466, DT530 and HT530, that are made and sold by the assignee of this application.

As is known, in a diesel-cycle engine, fuel is injected into the highly-compressed air within the cylinder 18 whereupon the air fuel mixture ignites and burns. In the embodiment shown in FIG. 1, the injector body 26 and the resulting fuel injection into the combustion chamber 18 occurs just before the piston 12 reaches the top of its travel in the cylinder 16, the precise occurrence of which is determined by the computer 50.

In the preferred embodiment of FIG. 1 there are shown, two series-connected hydraulic pistons 34 and 36. One piston is considered to be a "stroke limiter" piston 34 and the other is the slave piston 36. A first side or face 40A of the stroke limiter 34 is fluidly or fluidically coupled by a high pressure hydraulic engine fluid or oil line 43 to a first outlet 41 of the two-outlet, diverter valve 32. Another high-pressure hydraulic engine oil line 39 fluidly or fluidically couples the second side or face 40B of the stroke limiter 36 to the top or crown 37 of the slave piston 36. The bottom end 45 of the slave piston 36 is adjacent to and mechanically in contact with the top of the exhaust valve stem 38 of the exhaust valve 24. The series-operated stroke limiter or stoke limiter piston 34 and the slave piston 36 operate to controllably open the exhaust valve 24 when oil pressure is applied to the first side 40A of the stroke limiter 34. The oil pressure that performs that task is supplied from the high-pressure engine fluid or oil supply 28 via the diverter valve 32.

Inasmuch as diesel fuel injection normally occurs, at or near the top of the compression stroke, diverting the high pressure oil supply away from the fuel injector body 26 and instead to the, two series-connected control pistons 34 and 36, the slave piston 36 preferably being axially mounted directly above the exhaust valve stem 38, the normal timing of the injector control valve oil pressure pulse is nearly ideal to the timing at which the exhaust valve 24 should be made to open in an engine compression braking system. Stated alternatively, instead of activating the injector body and opening the fuel injector at the top of the compression stroke, the same control pulse of hydraulic fluid or oil 28 for the fuel injector 26 can be used instead to open the exhaust valve 24 thereby purging the cylinder 18 gas, which was compressed using, at least in part, the vehicle's momentum. By opening the exhaust valve 24 at or near the top of the compression stroke, the mechanical energy supplied by the vehicle and which was required to compress the air taken into the cylinder 18 during the intake stroke can be wasted to the atmosphere providing a substantially enhanced engine braking effect.

As shown in FIG. 1, the diverter valve 32 redirects the flow of high pressure engine fluid or oil 28 from the fuel injector body 26 to a stroke limiter piston 34. A front surface of the stroke limiter 40A has a surface area against which the pressure of the high pressure oil supply 28 is applied so as to hydraulically multiply, in conjunction with the slave piston 36, the force supplied from the high pressure engine oil supply 28, to a level sufficient to open the exhaust valve 24. The force supplied by the high pressure oil supply 28 must open the exhaust valve against the force of the exhaust valve spring (not shown for clarity) and the force applied to the valve face from the combustion chamber compressed gases.

The stroke limiter 34 is hydraulically coupled to the slave piston 36, which is mounted on and substantially coaxially with the stem 38 of the exhaust valve 24 and which also preferably has a relatively large cross-sectional area to further increase the force applied to the exhaust valve 24 from the high-pressure oil supply 28. As shown in FIG. 1, as the stroke limiter 34 travels upward, the upward translation of the stroke limiter 34 causes a downward displacement of the slave piston 36 against the top of the stem 38 of the exhaust valve 24.

In an alternate embodiment, the stroke limiter 34 has an adjustable length of travel (not shown in FIG. 1). By controlling the travel of the stroke limiter 34, the travel of the slave piston 36 can also be controlled thereby avoiding overextending the exhaust valve 24 into the cylinder and risking damage to the piston crown 20.

The exhaust valve 24 can be held in an open position for the duration of the pulse of high pressure engine fluid or oil 28 supplied to the slave piston 36, which is determined by the length of time that the injector control valve 30 is held open. The length of time that the injector control valve is open is controlled by injector control valve signals 58 from the computer 50. When engine compression is required, it may be desirable for the computer 50 to lengthen the open time of the injector control valve 30 thereby purging more of the compressed gas within the cylinder 18. The engine computer 50 is operably coupled to the injector control valve 30 and controls or determines the length of time that the injector control valve 30 is open to provide throttle control When engine compression braking is no longer required, the injector control valve 30 is switched to a purge position (not shown) by which the high-pressure oil in line 43 is dumped within the engine at an appropriate location (typically under the engine rocker arm cover.) In the absence of high-pressure oil or fluid applied to the face 40A of the stroke limiter, a stroke limiter spring 40C opposite the face 40A forces the stroke limiter to return to its resting position. Also, a slave piston spring 36B opposite face 37 causes the slave piston 36 to return to its normal position allowing the exhaust valve to operate normally. The slave piston spring 36B is operably coupled to the slave piston 36 preferably via a slave piston retaining snap ring 36C.

In the embodiment of FIG. 1, the working fluid, i.e. the hydraulic fluid is preferably engine lubricant oil. Alternate embodiments of the invention would be equally effective using non-engine-oil hydraulic fluids or gases. For claim construction purposes therefore, the term hydraulic fluid should be construed to include any liquid (as well as a gas) by which the fuel injector and slave piston can both be actuated.

In order to keep the volumes between the slave piston 36 and the stroke limiter 34 filled with oil at all times, a low-oil-pressure valve 42, continuously supplies fluid to the volume between the stroke limiter 34 and the slave piston 36 so as to make up oil volume therein which might be lost to leakage.

Figure 2:
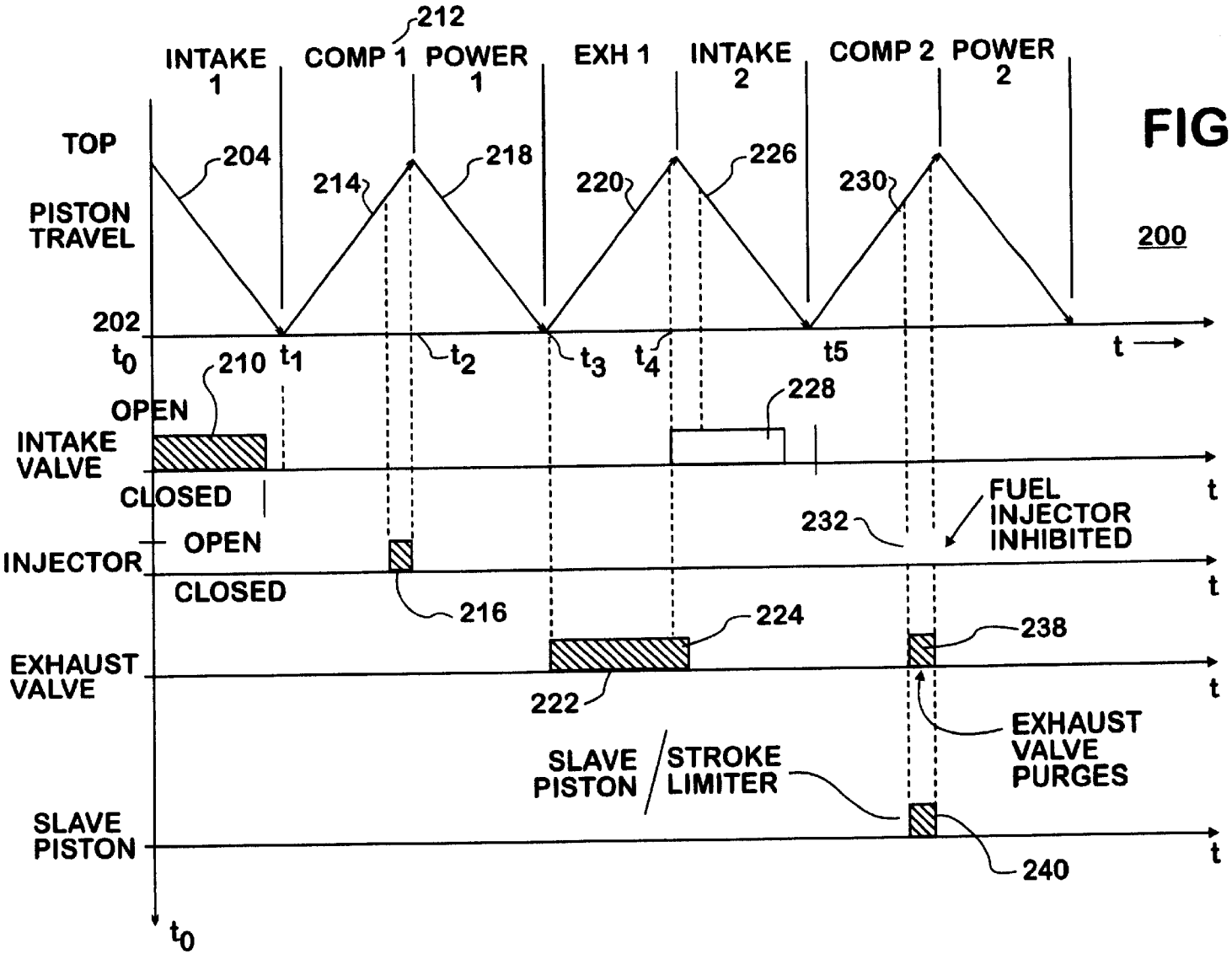
FIG. 2 shows a timing diagram that approximates the actuations of an intake valve, exhaust valve, fuel injector and the engine compressing braking apparatus shown in FIG. 1, as a function of the relative location of a piston through-out its travel.

FIG. 2 shows a simplified timing diagram of the travel of the piston 12 depicted in FIG. 1 and an approximation of the intake valve operation, the hydraulically actuated fuel injector 26 operation, the exhaust valve 24 action and the displacement of the slave piston/stroke limiter assembly 34 and 36 as a function of piston 12 travel during the four different cycles of a four-stroke (four-cycle) internal combustion engine. As described above, the exhaust valve 24 can be made to open using the hydraulically-operated slave piston 36.

During normal operation however, i.e., when the compression brake is not operating or actuated, intake and exhaust valve operation is achieved by a camshaft (not shown in FIG. 1) as those of skill in the art will appreciate. At time $t_0$, which is identified by reference numeral 202, the piston 12 begins a first intake stroke (identified by reference numeral 204) traveling downward in the cylinder 18. During this first intake stroke 204, a typical intake valve is opened (identified by reference numeral 210) by the engine's camshaft for a time period substantially between to and just before $t_1$. While the intake valve is open, the piston 12 draws in or sucks in outside air for subsequent use in the ensuing compression stroke, (identified by reference numeral 212). At the conclusion of the intake stroke the camshaft rotates with the crankshaft causing the intake valve to close.

As the piston travels upward in the cylinder 16 during the compression stroke 214, the fuel injector body 26 is opened, shown at time interval 216, for a relatively short time period during which fuel is injected into the combustion chamber 18. At time $t_2$, the piston 12 begins its downward travel as part of the power stroke (identified by reference numeral 218) during which the piston 12 supplies mechanical power to the engine crankshaft.

At time $t_3$, the first exhaust stroke begins (identified by reference numeral 220). Exhaust valve 24 is opened by the camshaft (not shown) during the time interval depicted by reference numeral 222. The camshaft's rotation will cause the exhaust valve to close at a time 224 just prior to $t_4$, which denotes the beginning of the second intake stroke 226.

The second intake stroke 226 can be considered to begin when engine compression braking is desired. However, those of skill in the art will readily recognize that engine compression braking can be selected by an operator at any time and does not necessarily have to be synchronized to any one stroke of a four-cycle engine.

In the second intake stroke 226, the camshaft opens the intake valve during time interval 228 and closes just before the time interval $t_5$. During the ensuing compression stroke 230, after an operator has activated engine compression braking, the fuel injector will be inhibited (as indicated by reference numeral 232) and no high pressure oil 28 will be routed to the fuel injector. The computer 50 will generate a diverter valve actuation signal 56 to the diverter valve 41. The diverter will actuate and thereby divert the high pressure oil supply 28 from the fuel injector 26 to the stroke limiter 34 which will actuate the slave piston 34 (indicated by reference numeral 240).

The engine computer 50 generates an injector control valve signal 58 that is sent to the injector control valve 30 as before, however the additional generation of the diverter valve actuation signal 56 actuates the diverter valve 41 to divert the flow of high pressure oil or fluid from the fuel injector to the stroke limiter 34. By diverting the high pressure oil supply 28 away from the fuel injector body 26 no fuel is injected into the combustion chamber 18 during the second compression stroke 230. Instead, the high pressure fluid or oil 28 is routed to the stroke limiter 34 which in turn actuates the slave piston 36. The slave piston 36 then acts on the exhaust valve 24 and opens the exhaust valve 24 (indicated by reference numeral 238) at the precise instant when the fuel injector would have opened had the engine been in normal operation mode instead of engine compression mode. The exhaust valve 24 opens when the slave piston 34 and stroke limiter 36 respond to the high pressure oil control pulse directed to them by the diverter valve 32 (indicated by reference numeral 240).

Prior art hydraulically actuated engine compression braking systems often required a separate high pressure engine compression braking oil supply in addition to a fuel injection high pressure oil supply. In the embodiment of the present invention, the existing fuel injection high pressure oil supply is simply redirected to a slave piston by redirecting or generating a hydraulic fluid signal or pressure pulse to a diverter valve. The diverted high pressure fluid then actuates a slave piston or stroke limiter/slave piston combination which opens the exhaust valve 24 at the optimum time at which the combustion chamber pressure should be purged to waste mechanical energy required to compress the cylinder contents.

While the preferred embodiment disclosed herein contemplates a stroke limiter 34 as a safety or control mechanism limiting the travel of the exhaust valve 24 as a result of the slave piston 36, those skilled in the art will recognize that in instances where the volume of high pressure oil supply 28 delivered to the slave piston 36 can be closely controlled, the stroke limiter 34 may be redundant. Accordingly, at least one alternate embodiment contemplates an engine compression brake comprised of an oil pressure supply, diverter valve and the slave piston. Such an embodiment, as mentioned above, requires a more precise control of the fluid delivered to the slave piston so as to avoid forcing the exhaust valve 24 downward in an amount exceeding the safe clearance between the piston crown 20 and the limit of the exhaust valve travel. Stated alternatively, if the slave piston 36 travels too large a distance such that the exhaust valve exceed the safe clearance, the exhaust valve would travel too far into the combustion chamber 18 possibly striking the top of the piston crown resulting in severe damage to the engine.

The invention has been described and illustrated with respect to certain preferred embodiments by way of example only. Those skilled in that art will recognize that the preferred embodiments may be altered or amended without departing from the true spirit and scope of the invention. Therefore, the invention is not limited to the specific details, representative devices, and illustrated examples in this description. The present invention is limited only by the following claims and equivalents.

I claim:

1. In an internal combustion engine having a source of pressurized fluid for a hydraulically-actuated fuel injector, said engine further having at least one exhaust valve through which combustion chamber gases can pass between the combustion chamber and the atmosphere, a method of controlling said exhaust valve so as to provide engine compression braking comprised of the steps of:

operatively coupling a pressure-actuated piston to said at least one exhaust valve, said pressure-actuated piston being capable of opening said exhaust valve in response to the application of pressure to said pressure-actuated piston;

directing the pressurized fluid from an output of a fuel injector control valve into a controllable diverter valve;

when the diverter valve is in a first position, directing the pressurized fluid from the diverter valve to an oil input of the fuel injector that operates to inject fuel into a combustion chamber in response to the application of pressurized engine oil through the oil input of said fuel injector;

when the diverter valve is in a second position, controllably diverting said pressurized fluid from said fuel injector to said pressure-actuated piston, thereby substantially inhibiting said fuel injector operation and simultaneously opening said exhaust valve.

2. The method of claim 1 wherein said step of controllably diverting said pressurized fluid from said fuel injector to said pressurized fluid-actuated piston is comprised of the step of diverting said pressurized fluid to said pressurized-fluid-actuated piston to provide engine compression braking to a vehicle driven by said engine.

3. The method of claim 1 wherein the pressure of said pressurized fluid increases and decreases periodically so as to open and close said fuel injector in substantial synchronization with the engine crankshaft rotation, when said pressurized fluid is not diverted to said pressure actuated piston.

4. The method of claim 1 wherein the pressure of said pressurized fluid increases and decreases periodically so as to open and close said at least one exhaust valve in substantial synchronization with the engine crankshaft rotation when said pressurized fluid is diverted to said pressure actuated piston.

5. The method of claim 1, further including the step of changing a time during which said exhaust valve is opened.

6. In an internal combustion engine having a source of pressurized fluid for a hydraulically-actuated fuel injector, said engine further having at least one exhaust valve through which combustion chamber gases can pass between the combustion chamber and the atmosphere, a method of controlling said exhaust valve so as to provide engine compression braking comprised of the steps of:

operatively coupling a pressure-actuated slave piston to said at least one exhaust valve, said pressure-actuated slave piston being capable of opening said exhaust valve in response to oil pressure delivered to said pressure-actuated slave piston from an external source of pressurized fluid;

diverting said pressurized fluid from said fuel injector to a stroke limiter piston in response to an engine compression brake signal, said stroke limiter piston having an input face receiving said pressurized fluid and an output face, said output face being hydraulically coupled to the pressure-actuated slave piston, such that upon the diversion of said pressurized fluid to said stroke limiter, said stroke limiter displacement displaces the slave piston, opening said exhaust valve at substantially the end of the engine's compression stroke.

7. The method of claim 6 further including the step of adjusting the time during which said exhaust valve is open by adjusting the open time of a fuel injector control valve through which high pressure fluid is delivered.

8. An internal combustion engine comprised of:

at least one, pressure-actuated fuel injector operable to deliver fuel to an engine combustion chamber upon the application of pressurized fluid thereto;

an exhaust valve, through which combustion chamber gases can pass between the combustion chamber and the atmosphere;

a slave piston, operatively coupled to said exhaust valve, capable of being fluidically coupled to the at least one, pressure-actuated fuel injector, capable of opening said exhaust valve in response to the application of pressurized fluid to said slave piston;

a fluid diverter valve having an input coupled to a source of pressurized fluid and further having a first output coupled to said fuel injector and a second output coupled to said slave piston, said fluid diverter being operable to either: enable said fluid injector upon the application of pressurized fluid or open said combustion chamber exhaust valve; and a fuel injector control valve having an input fluidically coupled to a source of high pressure engine oil and having an output coupled to the input of said fluid diverter valve.

9. The internal combustion engine of claim 8, further including a stroke limiter fluidically coupled between said fuel injector and said slave piston.

10. The internal combustion engine of claim 8, further including a computer, operably coupled to said fuel injector control valve so as to control the time during which said exhaust valve is open by controlling the open time of said fuel injector control valve.

11. In a diesel engine having at least one, oil-pressure-actuated fuel injector, which operates to inject fuel into a combustion chamber in response to the application of pressurized engine oil, an apparatus for providing engine compression braking comprised of:

slave hydraulic piston means, for opening an exhaust valve in response to the application of hydraulic pressure thereto;

a controlled engine oil diverter valve having an input receiving said pressurized engine oil, and further having a first output coupled to said at least one oil-pressure-actuated fuel injector, and having a second output coupled to said slave hydraulic piston means, said diverter valve enabling said fuel injector and disabling engine braking in a first position and disabling said fuel injector and enabling engine braking when in a second position.

12. A diesel engine comprising:

a fuel injector control valve having a control input, an oil input coupled to a source of high-pressure engine oil and having an oil output;

a controllable diverter valve, having an input coupled to said oil output of said fuel injector control valve and further having first and second outputs;

at least one, oil-pressure-actuated fuel injector having an oil input coupled to said second oil output of said controllable diverter valve and which operates to inject fuel into a combustion chamber in response to the application of pressurized engine oil through said oil input of said fuel injector;

slave hydraulic piston means, for opening an exhaust valve in response to the application of hydraulic pressure thereto, having an input coupled to said first output of said controllable diverter device.

13. The diesel engine of claim 12 further including a computer having a first output coupled to said fuel injector control valve and providing signals thereto that control the amount of time that said fuel injector control valve is open; further having a second output coupled to said controllable diverter valve which controls said diverter valve so as to provide either engine compression braking or fuel to said engine.

14. A method for compression engine braking in an internal combustion engine, having a source of pressurized fluid for a hydraulically-actuated fuel injector, comprising the steps of:

directing pressurized fluid from a fuel injector control valve to a diverter valve;

activating compression engine braking mode;

generating a diverter valve actuation signal in an engine computer;

actuating the diverter valve based on the diverter valve actuation signal thereby diverting the pressurized fluid to the fuel injector towards a slave piston;

actuating the slave piston via the diverted high pressure fluid; and actuating an exhaust valve for a predetermined amount of time at or near the top of a compression stroke, via translation of the slave piston movement, to thereby vent compressed gases in a combustion chamber to the atmosphere.

15. A method for compression engine braking in an internal combustion engine, having a source of pressurized fluid for a hydraulically-actuated fuel injector, comprising the steps of:

activating compression engine braking mode;

generating a diverter valve actuation signal in an engine computer;

actuating the diverter valve based on the diverter valve actuation signal thereby diverting the pressurized fluid from the fuel injector towards a stroke limiter piston;

actuating the stroke limiter piston via the diverted high pressure fluid;

actuating a slave piston by translating the movement of the stroke limiter piston via hydraulic coupling means between the stroke limiter and the slave piston; and actuating an exhaust valve for a predetermined amount of time at or near the top of a compression stroke, via translation of the slave piston movement, to thereby vent compressed gases in a combustion chamber to the atmosphere.

16. A compression engine brake for an internal combustion engine wherein the engine includes a source of pressurized fluid for at least one hydraulically-actuated fuel injector, at least one fuel injector control valve for selectively delivering pressurized fluid to a corresponding fuel injector, at least one exhaust valve through which gases can travel from the combustion chamber to the atmosphere, and an engine computer for monitoring and controlling engine functions; the engine compression brake comprising:

a fuel injector control valve having a control input operably coupled the engine computer and having a fluid input coupled to the source of pressurized fluid and having a fluid output;

a diverter control valve, having an input coupled to a fluid output of the fuel injector control valve and having a first output coupled to a fluid input of the fuel injector, for diverting pressurized fluid from the fuel injector in response to a diverter control valve actuation signal from the engine computer; and a slave piston, coupled to a second output of the diverter control valve, for opening the exhaust valve in response to the diverted pressurized fluid to thereby vent compressed gases in a combustion chamber to the atmosphere.

17. A compression engine brake for an internal combustion engine wherein the engine includes a source of pressurized fluid for at least one hydraulically-actuated fuel injector, at least one fuel injector control valve for selectively delivering pressurized fluid to a corresponding fuel injector, at least one exhaust valve through which gases can pass from a combustion chamber to the atmosphere, and an engine computer for monitoring and controlling engine functions; the engine compression brake comprising:

a diverter control valve for diverting pressurized fluid from the fuel injector in response to a diverter control valve actuation signal from the engine computer;

a stroke limiter piston having an input face for receiving the diverted pressurized fluid and an output face such that upon the diversion of the pressurized fluid to the stroke limiter piston input face, the stroke limiter piston is displaced; and a slave piston hydraulically coupled to the stroke limiter piston via the output face such that the stroke limiter piston displacement displaces the slave piston which in turn actuates and opens a corresponding exhaust valve at substantially the end of the engine's compression stroke to vent compressed gases from the combustion chamber to the atmosphere.

* * * * *